United States Patent [19]

Park

[11] 4,398,502

[45] Aug. 16, 1983

[54] WATER HEATER WITH UP-DOWN FLOW FLUE

[76] Inventor: Ki D. Park, 1424-3 3KU, Sankyuk Dong, Buk-Ku, Taegu, Rep. of Korea

[21] Appl. No.: 241,621

[22] Filed: Mar. 9, 1981

[30] Foreign Application Priority Data

Jul. 28, 1980 [KR] Rep. of Korea ..... 4799

[51] Int. Cl.[3] ..... F22B 5/00

[52] U.S. Cl. ..... 122/17; 122/157; 126/364

[58] Field of Search ..... 122/13 R, 14, 16, 17, 122/18, 19, 136 R, 157, 158; 126/364

[56] References Cited

U.S. PATENT DOCUMENTS 1,933,056 10/1933 Hamilton ..... 122/17
2,219,809 10/1940 Derby ..... 122/19
2,356,928 8/1944 Hann ..... 431/62
2,698,007 12/1954 Tegler ..... 122/13 R
4,203,392 5/1980 McLane ..... 122/17

*Primary Examiner*—Ronald C. Capossela
*Attorney, Agent, or Firm*—John F. McClellan, Sr.

[57] ABSTRACT

An efficiency and safety and economy-improved water heating system with a water-containing casing around a coaxially central upright flue having a combustion chamber at the bottom which is open for the purpose and a closed upper end, and, connecting with the upper end of the upright flue, a plurality of downdraft flue elements passing helically downward through the water-containing casing to a power-exhaust element which positively draws combustion by-products up through the flue and down through the flue elements for heating water flowed through the casing; improved, readily removable perforate basket burner structure produces diverse, well ventilated combustion paths in the combustion chamber further enhancing efficiency and safety and ability to use the unit with gas or oil.

8 Claims, 7 Drawing Figures

WATER HEATER WITH UP-DOWN FLOW FLUE

This invention relates generally to fluid heating and specifically to combustion devices for heating water.

BACKGROUND OF THE INVENTION

In the prior art various updraft combustion devices for heating water have been known, such as the common gas fueled or oil fueled household water heater with a vertical flue within a water containing casing.

However, a large part of the heat of combustion when exchanging heat to water in such devices goes up the chimney, either straight up or essentially all the way in an upward direction inside the upwardly directed flue.

To reduce such losses it has been necessary to provide taller water heating apparatus, increasing the area to be insulated and increasing the space required for installation of the water heating apparatus.

OBJECT OF THE INVENTION

A principal object of the present invention is to increase efficiency of water heaters by reducing such unnecessary heat losses and improving heating path, arm, and mixing during the interchange with water in the water heating apparatus while at the same time reducing the overall height of the water heating apparatus, decreasing the area to be insulated and the cost.

Further objects are to increase burner efficiency, to provide for easy burner assembly and removal and to provide good access for inspection and cleanout of water heating apparatus.

BRIEF SUMMARY OF THE INVENTION

In brief summary given as cursive description only and not as limitation, the invention includes in combination a water heating system with a water-containing casing around an upright central flue having at the bottom a combustion chamber, a closable upper end, and a plurality of peripheral downdraft flue elements in the casing, connecting with the upright flue at the top and passing in a substantially helical extended path downward to a partial-vacuum exhaust.

BRIEF DESCRIPTION OF THE DRAWINGS

The above and other objects and advantages of the invention will become more readily understood from the following description, in which like characters refer to like parts.

DETAILED DESCRIPTION OF THE DRAWINGS

Figure 1:
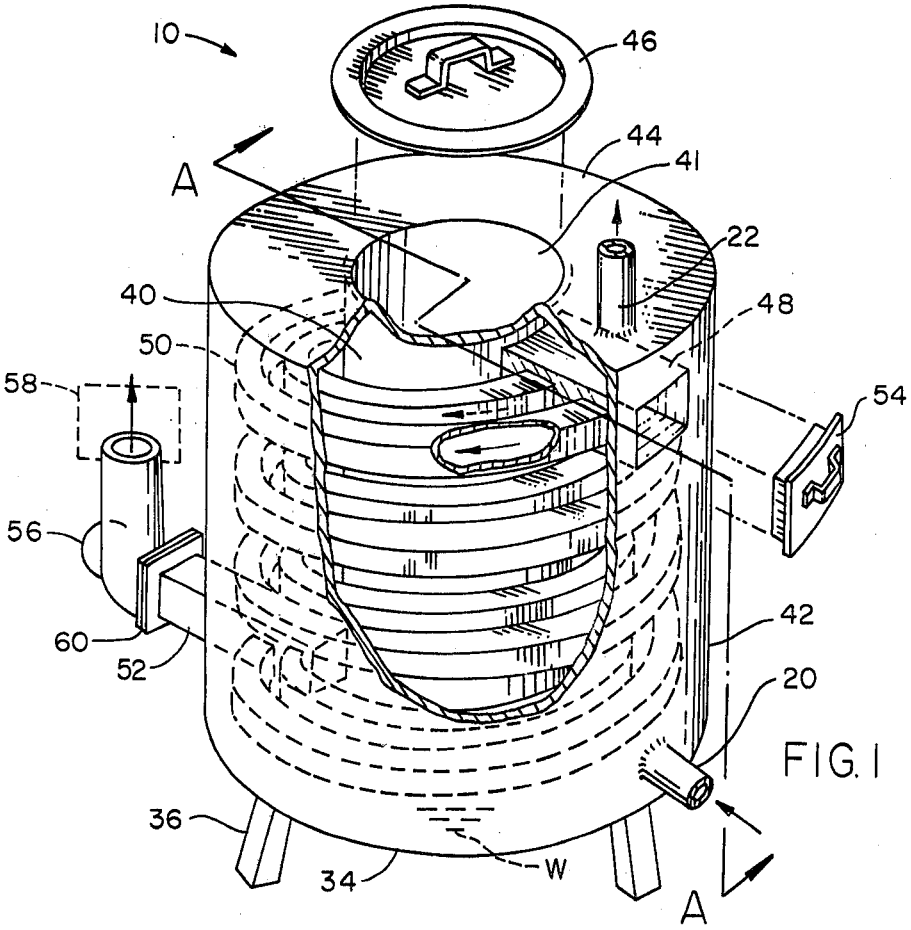
FIG. 1 is a partially fragmentary, perspective view of a first embodiment.
Figure 2:
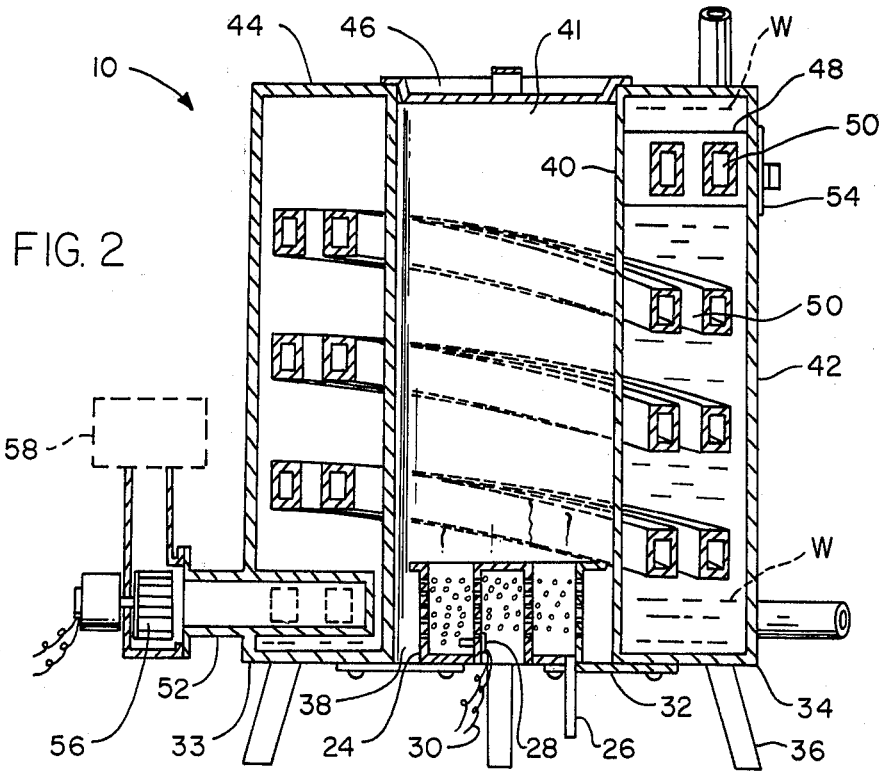
FIG. 2 is a sectional view taken at A—A, FIG. 1.

FIGS. 1 and 2 show the preferred mode of the invention 10 as comprising a fluid heater for water and the like, with combination updraft/downdraft heat exchanger means and a partial-vacuum exhaust to insure proper fume passage for better heating water W passed into the system at 20 and out of the system at 22.

Burner or burner assembly 24 may be an oil burner supplied through fuel pipe 26, having a conventional electrical igniter 28 supplied through wires 30, and held in place by relatively narrow straps 32 screwed to the bottom 33 of casing 34. Legs 36 provide spacing for air for combustion to pass (arrows) up through the bottom into the burner, and into the combustion chamber 38 which is the lower end of preferably coaxial and preferably uniform-diameter centrally located, upright flue 40. Uniformity of diameter adapts the unit for use with burners of different heights as desired, or for mounting a burner at any desired height, and permits downward removal of the burner. The water, held between the outer wall 42 of casing 34 and the upright flue, which forms the inner wall of the casing, the space being sealed by the integral bottom and the top 44, is heated by exchange through the wall of the upright flue, and then is heated by another exchange with the flue system according to important principles of this invention, as follows. Element 41 is the upright flue passage.

A top plate 46, which is removable for inspection and cleanout, covers the upper end of the upright flue at the top of the system.

An entrance header 48 radial to the upright flue connects the upright flue with fume exhaust means in the form of a plurality of downdraft heat exchanger tubes 50 connected to have parallel flow paths and extending in a circumferential direction from the chamber formed by the entrance header downward in preferably substantially helical run through the water to connection in a circumferential direction to a chamber of an exhaust header 52. Closure 54 on the end of the entrance header which passes throught the casing wall affords good access for inspection and cleanout. Two tubes 50 may be provided.

Exhaust means 56, which may be a rotary fan of the squirrel cage type provides sufficient lowering of pressure or partial vacuum to draw the hot fumes safely down from the top of the upright flue and expel them either as waste or into further heat-using means such as a gas-to-air heat exchanger schematically represented at 58. Eventually the spent, cooled fumes are exhausted to the open air. Detachable connection 60 of the fan provides ready access for inspection and cleanout. Screw attachment may be used.

The downwardly extending downdraft heat exchanger tubes 50 may advantageously be disposed in the form of an array of coaxially congruent helixes of a size individually such that the sum of the cross-section dimension of the plurality of tubes amounts substantially equals one-half the radial distance between the upright flue and the outer wall of the casing. Preferably also there is a uniform gap between the helixes and between the wall of the upright flue and the casing outer wall and the helixes. Such structure urges water admitted at the bottom (or at the top if desired) of the heater, to follow a thermally efficient long helical path to the water egress.

Although helical forms are described, it will be appreciated that distortion approximations of helical shape will be within the spirit of the invention although less preferable; reduction of water short-cuts, improved mixing and greater path and heat exchange surface area being important advantages to be preserved.

Figure 3:
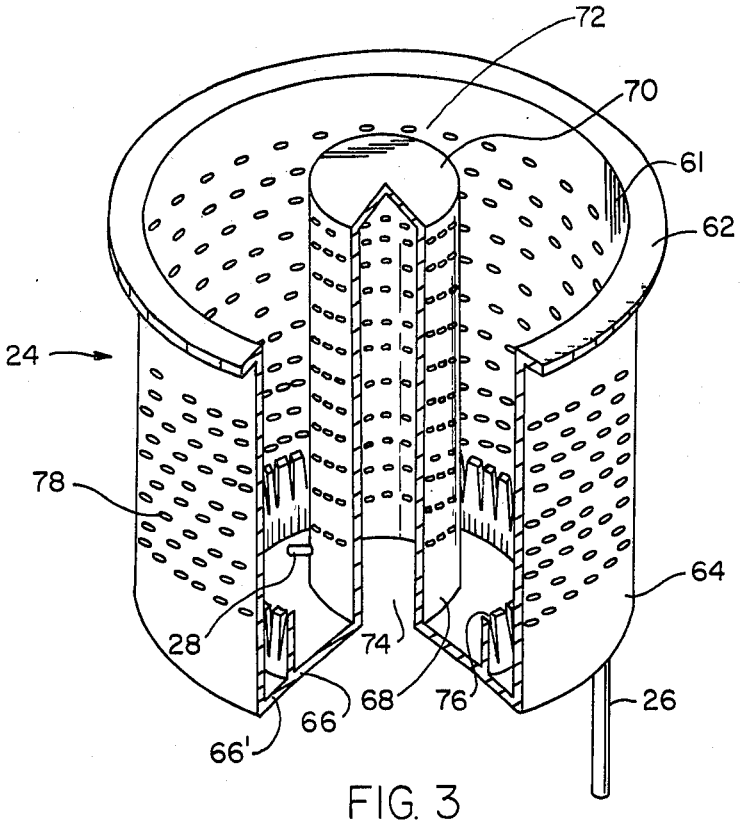
FIG. 3 is a partly sectional perspective view of the burner shown at the bottom center of FIG. 1.
Figure 4:
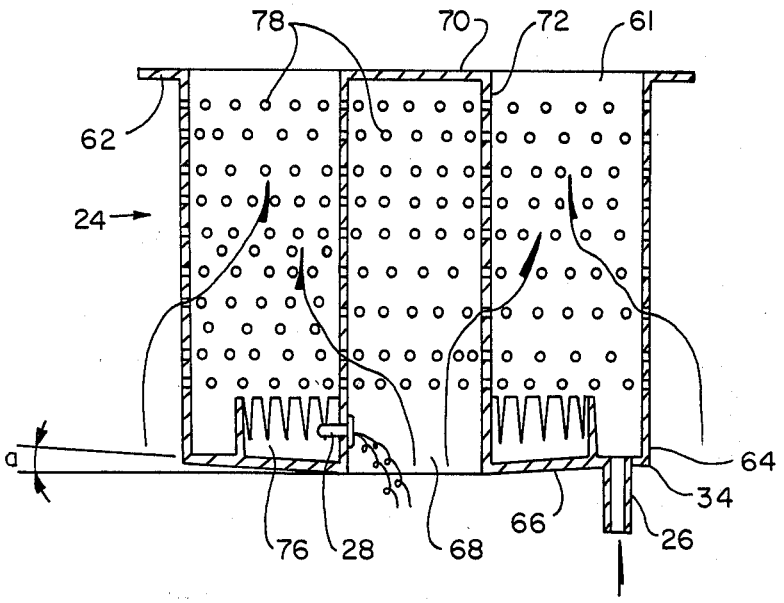
FIG. 4 is a sectional elevational view of the burner of FIG. 3.

FIGS. 3 and 4 show further details of the burner assembly 24, which essentially may be a perforate-wall basket 61, generally, except for: flange 62, the lower wall 64 of the basket, and the bottom 66 of the basket which slopes down to the center and the lower skirt 68 and top 70 of perforate tower 72 which has an open bottom 74, and which rises coaxially in the center as part of the basket, preferably coextensive in height with the outwardly extending top flange 62 on the perimeter of the perforate basket. Bottom part 66′ may be planar.

The igniter 28 protrudes outwardly through the skirt of the tower in position to ignite oil vapors from a thin layer of oil which is introduced outside serrate ring 76, and which sparingly flows and creeps through the "V" notches or serrations in the ring top and towards the igniter as result of the sloped bottom of the basket; the angle of slope may be from five to ten degrees. The ring seals on the basket bottom.

The notches lie at a lower level than the lowermost of perforations 78 in the outer wall and the tower. The serrated ring is preferably coaxial in the burner assembly. Oil level may be maintained by any suitable means, such as a conventional float bowl like that used in automotive systems, or other of the well-known pressure-head controllers in the line 26 away from the heat.

The basket and tower perforations disperse and direct air to the combustion regions in the basket (arrows) and the flange 62 fits tightly enough inside the upright flue to prevent an appreciable amount of air from bypassing the combustion area.

Figure 5:
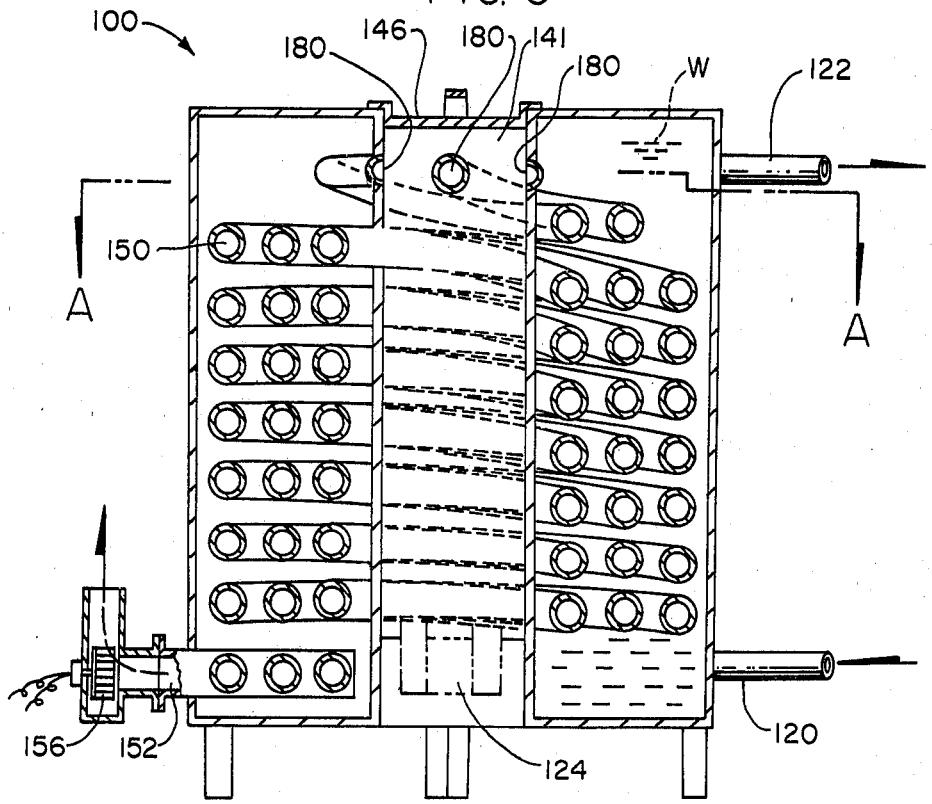
FIG. 5 is a sectional view similar to that of FIG. 2 but of a further embodiment.
Figure 6:
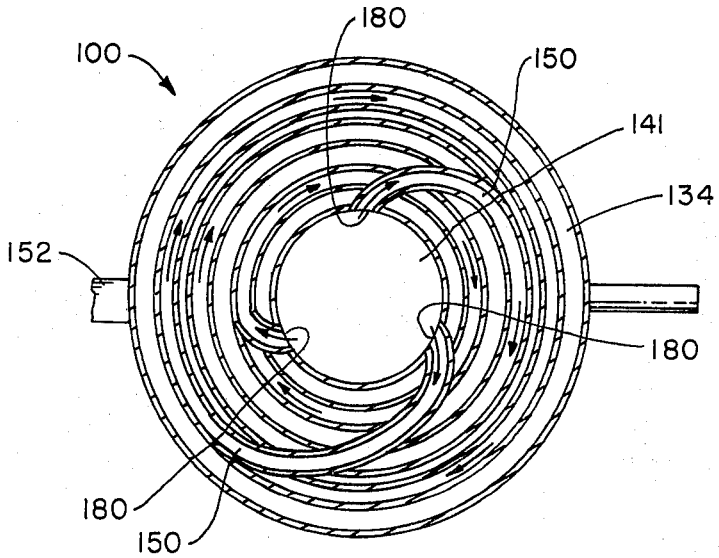
FIG. 6 is a sectional view taken at A—A, FIG. 5.
Figure 7:
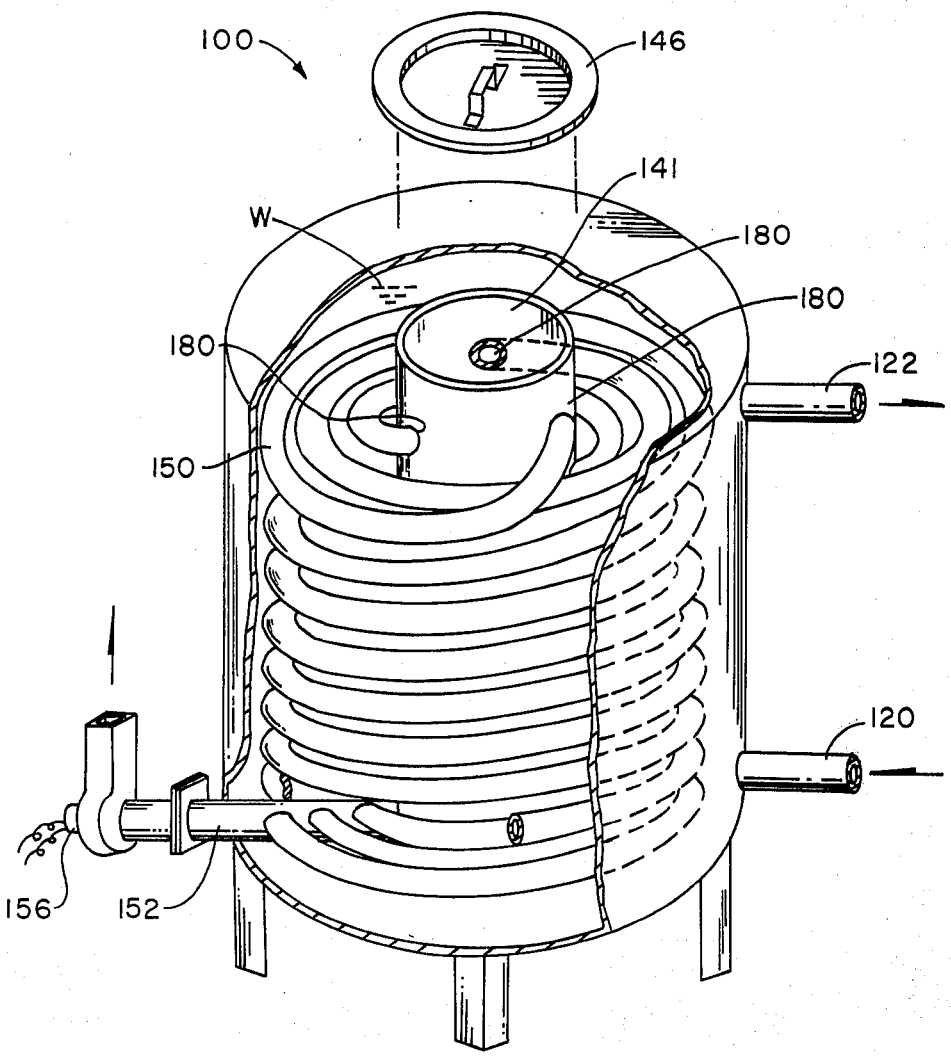
FIG. 7 is a partially fragmentary perspective view of the FIG. 5 embodiment.

FIGS. 5, 6 and 7 illustrate an embodiment 100 which is similar to the previous embodiment except that the plurality of tubes 150 are substantially circular in cross section instead of rectangular, and there is no entrance header but instead the tubes 150 have individual tangential connection 180 to the upright flue circumferentially spaced from each other and respectively spiral outward to said helical extension, thereby facilitating fume flow, inspection and cleanout on removal of plate 146. Three tubes 150 may be provided, the principle being the same as before.

An exhaust header 152 is provided. Burner assembly 124 is as before, as are ingress 120 and egress 122, and the other elements including flue space 141. The burner assembly is shown diagrammatically and in a higher position where it may be held by spacers, not shown on a mount similar to that previously described.

Materials for the units may be steel preferably either galvanized to prevent rust or stainless; copper is also a useful alternative. Assembly of the integral parts may be by welding or brazing, with the burner assembly bolted in place and shimmed to desired height using metal shims, if desired, over the straps.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States letters patent is:

1. An improved system for heating a fluid such as water, of the type having: a casing with entrance and egress for water held therein for heating, a burner, a flue system including: an upright flue in the casing as heat exchanging means, a combustion chamber at the lower end of the upright flue and connecting therethrough with fume exhaust means, wherein the fume exhaust means extends downward through the casing as downdraft heat exchanging means, means connecting with the lower end of the downdraft heat exchanging means for drawing fumes downward out of the flue system, said downdraft heat exchanging means comprising a plurality of tubes connected to have respectively parallel flow paths therethrough, said extension downward being a substantially helical extension, the upright flue having an open bottom, a removable closure covering the top of the upright flue, providing access for inspection and cleanout, and an entrance header forming a first chamber between the upright flue and the downdraft heat exchanging means and connecting radially to the upright flue and circumferentially to said plurality of tubes of the downdraft heat exchanging means.

2. An improved system for heating a fluid such as water, of the type having: a casing with entrance and egress for water held therein for heating, a burner, a flue system including: an upright flue in the casing as heat exchanging means, a combustion chamber at the lower end of the upright flue and connecting therethrough with fume exhaust means; wherein the fume exhaust means extends downward through the casing as downdraft heat exchanging means, means connecting with the lower end of the downdraft heat exchanging means for drawing fumes downward out of the flue system, said downdraft heat exchanging means comprising a plurality of tubes connected to have respectively parallel flow paths therethrough, said extension downward being a substantially helical extension, the upright flue being generally central in the casing, and the casing being generally circular in section and coaxial with the upright flue and with the downward helical extension of the plurality of tubes.

3. An improved system for heating a fluid such as water, of the type having: a casing with entrance and egress for water held therein for heating, a burner, a flue system including: an upright flue in the casing as heat exchanging means, a combustion chamber at the lower end of the upright flue and connecting therethrough with fume exhaust means; wherein the fume exhaust means extends downward through the casing as downdraft heat exchanging means, means connecting with the lower end of the downdraft heat exchanging means for drawing fumes downward out of the flue system, said downdraft heat exchanging means comprising a plurality of tubes connected to have respectively parallel flow paths therethrough, said extension downward being a substantially helical extension, the upright flue being generally central in the casing, and the casing being generally circular in section and coaxial with the upright flue and with the downward helical extension of the plurality of tubes, and a removable closure covering the top of the upright flue, providing access for inspection and cleanout.

4. A system as recited in claim 1, wherein the entrance header passes through the casing to a removable cover providing access for inspection and cleanout at the upper end of said plurality of tubes.

5. A system as recited in claim 4, wherein an exhaust header forms a second chamber between the downdraft heat exchanging means and said means for drawing fumes downward, and connects circumferentially to the downdraft heat exchanging means and radially to the means for drawing fumes downward.

6. A system as recited in claim 5 wherein said radial connection to the means for drawing fumes downward is a disconnectable connection, providing access for inspection and cleanout.

7. An improved system for heating a fluid such as water, of the type having: a casing with entrance and egress for water held therein for heating, a burner, a flue system including: an upright flue in the casing as heat exchanging means, a combustion chamber at the lower end of the upright flue and connecting therethrough with fume exhaust means; wherein the fume exhaust means extends downward through the casing as downdraft heat exchanging means, means connecting with the lower end of the downdraft heat exchanging means for drawing fumes downward out of the flue system, said downdraft heat exchanging means comprising a plurality of tubes connected to have respectively parallel flow paths therethrough, said extension downward being a substantially helical extension the upright flue having an open bottom, said plurality of tubes of the downdraft heat exchanging means respectively having individual tangential connection to the upright flue circumferentially spaced from each other, the plurality of tubes respectively spiralling outward to said substantially helical extension, thereby facilitating fume flow, inspection and cleanout, and said substantially helical extension including array of the plurality of tubes as coaxially congruent helixes.

8. A system as recited in claim 7, wherein said plurality of tubes have respective substantially circular cross-section.

* * * * *